United States Patent [19]

Chap

[11] 4,444,320

[45] Apr. 24, 1984

[54] STACKABLE SHELF UNIT

[75] Inventor: John P. Chap, Lemont, Ill.

[73] Assignee: Selfix, Inc., Chicago, Ill.

[21] Appl. No.: 299,319

[22] Filed: Sep. 4, 1981

[51] Int. Cl.[3] ..... A47F 5/00

[52] U.S. Cl. ..... 211/134; 206/511; 211/194

[58] Field of Search ..... 211/128, 134, 194; 108/91, 53.1, 53.3, 53.5, 101; 206/513, 511, 512

[56] References Cited

U.S. PATENT DOCUMENTS

| | | | |
|---|---|---|---|
| 921,694 | 5/1909 | Hall | 206/511 X |
| 967,600 | 8/1910 | Bernstein | 211/134 |
| 1,648,025 | 11/1927 | Molloy | 206/513 X |
| 1,697,789 | 1/1929 | Snyder | 206/511 X |
| 1,856,935 | 5/1932 | Turner | 108/91 X |
| 2,600,191 | 6/1952 | Beach | 211/194 |
| 2,836,304 | 5/1958 | Fürrer | 211/194 X |
| 2,869,731 | 1/1959 | Axelrod | 211/194 |

FOREIGN PATENT DOCUMENTS

| | | | |
|---|---|---|---|
| 407455 | 8/1966 | Switzerland | 211/194 |
| 943443 | 12/1963 | United Kingdom . | |
| 1297910 | 11/1972 | United Kingdom . | |

*Primary Examiner*—William E. Lyddane
*Assistant Examiner*—Peter A. Aschenbrenner
*Attorney, Agent, or Firm*—Dressler, Goldsmith, Shore, Sutker & Milnamow, Ltd.

[57] ABSTRACT

A stackable shelf unit is disclosed which is adapted to be stacked and supported upon a like shelf unit. The shelf unit is preferably fabricated from plastic coated metal wire, and includes a pair of spaced side frame members between which extend a plurality of spaced shelf members. The side frame members each include a pair of downwardly depending leg portions, with each leg portion including an offset portion adapted to engage and be supported upon the like shelf unit so that the shelf unit may be stacked thereupon.

3 Claims, 1 Drawing Figure

STACKABLE SHELF UNIT

TECHNICAL FIELD OF THE INVENTION

The present invention relates generally to utility shelf arrangements, and more particularly to a stackable, coated wire shelf unit.

BACKGROUND OF THE INVENTION

Coated wire products are widely available in the form of shelves, racks, and other like household conveniences. Products of this description are usually fabricated from metal wire which is appropriately shaped, and which is coated with vinyl or other plastic material. The resultant coated wire product is suitably corrosion and scratch resistant. The vinyl coating is available in a variety of colors for a pleasing appearance, and provides a resilient surface suitable for engaging porcelain, formica, metal, and other household surfaces without scratching or marring.

One type of coated wire product which is particularly convenient is a utility shelf which is suitable for use in the kitchen, bathroom, and other areas where shelving accommodates easy storage and use of items found in the home. While some shelves of this type may be hung from a wall, others are adapted to be free-standing, and may be placed in cabinets, pantries, vanities, or the like.

One desirable feature for free-standing shelf units is the capability of the shelf unit being stackable and supported upon a like shelf unit. In this way, a user may conveniently select the number of shelf units desired for use in a particular location, and readily stack the units so that, in essence, a multitiered shelf arrangement is provided. This feature of shelf arrangements of this type permits a user to "customize" the shelving units to their individual needs, with addition to or reduction of the number of shelf units being easily accomplished whenever desired.

To this end, a coated wire stackable shelf unit combining the convenience of a stackable shelf arrangement with the desirable features of coated wire products would be particularly useful.

SUMMARY OF THE INVENTION

In accordance with the present invention, a stackable shelf unit is disclosed which is adapted to be supported by and stacked upon a like shelf unit. The shelf unit is preferably fabricated from vinyl or plastic coated metal wire for corrosion resistance and a pleasing resilient finish.

The stackable shelf unit of the present invention includes a pair of laterally spaced side frame members. Each side frame member has a generally inverted U-shaped configuration, and includes a shelf support portion and a pair of integral, downwardly depending legs at each end of the shelf support portion.

The shelf unit further includes a plurality of spaced shelf or support members which are connected with and extend between the side frame members for supporting objects on the shelf. The shelf members are preferably joined to the side frame members, such as by welding, before the entire assembly is coated with vinyl or other suitable plastic material.

In order to provide the novel stackable feature of the present invention, the shelf unit further includes engagement means associated with each of the legs of the unit for engagement with an associated like shelf unit for support in stacking thereon. The engagement means preferably comprise an offset portion of each of the legs of the shelf units. Each offset portion is adapted to engage a portion of the like shelf unit, such as a portion of one of the transversely extending shelf members, or a portion of the side frame. Notably, the resilient vinyl coating of the shelf unit provides a highly frictional interengagement of like shelf units for secure stacking and stability.

Numerous other advantages and features of the present invention will become readily apparent from the following detailed description of the invention and embodiment thereof, from the claims and from the accompanying drawings in which like numerals are employed to designate like parts throughout the same.

BRIEF DESCRIPTION OF THE DRAWINGS

The single FIGURE is a perspective view of the shelf unit of the present invention shown stacked upon a like shelf unit (shown in phantom).

DESCRIPTION OF THE PREFERRED EMBODIMENT

Figure 1:
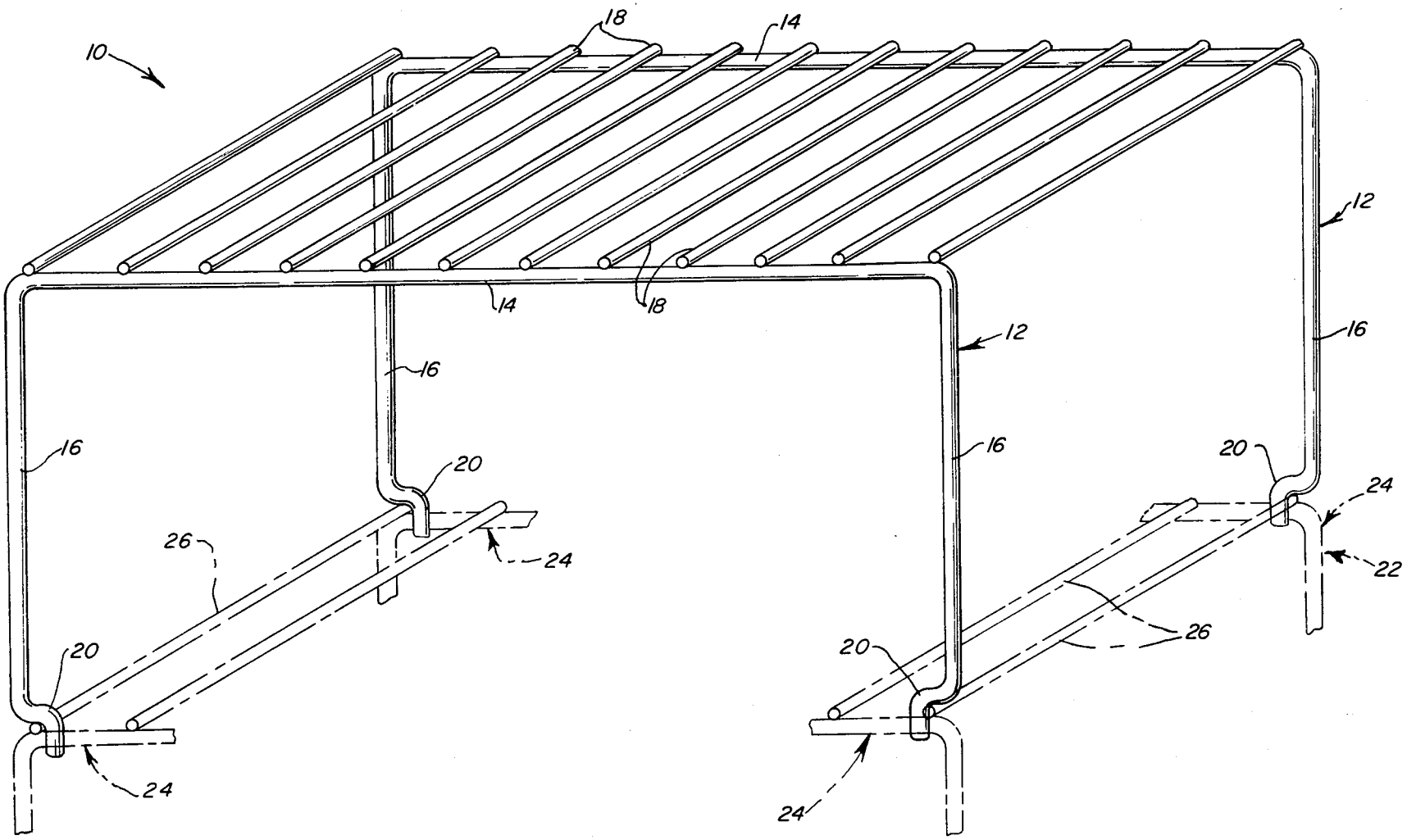

While the present invention is susceptible to embodiment in different forms, there is shown in the drawings and will hereinafter be described a presently preferred embodiment with the understanding that the present disclosure is to be considered as an exemplification of the principles of the invention and is not intended to limit the invention to the embodiment illustrated.

With reference now to the drawing therein is illustrated stackable shelf unit 10. Preferably, shelf unit 10 is fabricated from so-called coated wire. Materials of this description consist of metal wire having various shapes and sizes which is formed to the desired configuration. The entire arrangement may then be coated with vinyl or other suitable plastic material so that the entire assembly has a pleasing appearance, resists corrosion and scratching, and provides a resilient surface which avoids scratching or marring of surfaces upon which the shelf unit is positioned. Additionally, the resilient nature of the plastic coating of the preferred embodiment of the present invention affords a highly frictional interengagement of shelf unit 10 with a like shelf unit when stacked thereon as will be described.

As shown, shelf unit 10 includes a pair of laterally spaced side frame members 12. Each side frame member 12 has a generally inverted U-shaped configuration, and includes a generally horizontal shelf portion 14, and a pair of integral, downwardly depending leg portions 16. Each side frame member 12 is preferably fabricated fom a single length of metal wire bent or otherwise formed to the desired configuration.

In order to provide for support of objects on shelf unit 10, it further includes a plurality of laterally extending spaced shelf or support members 18 extending between and connected with shelf portions 16 of side frame members 12. Each shelf member 18 preferably comprises a single length of metal wire which is suitably affixed to each side frame 12 such as by welding, before the entire shelf unit is coated with plastic material.

The stackable nature of shelf unit 10 is provided in a novel yet straightforward fashion effective for accommodating stacking of the shelf units. Each leg portion 16 of side frame members 12 is provided with means for engaging portions of a like shelf unit. Preferably, each leg portion includes an offset portion 20 having a generally Z-shaped configuration. As clearly shown, each offset portion 20 forms a shoulder and is adapted to engage and fit against a like shelf unit 22 (shown in phantom) which includes side frame members 24 and shelf members 26. The offset portions 20 extend longitudinally inwardly of shelf unit 10 so that the offset portions readily fit against and are supported upon shelf members 26 of shelf unit 22. However, offset portions 20 could easily be formed so as to extend laterally inwardly of shelf unit 10, and thus be adapted to be supported upon side frame members 24 of shelf unit 22.

As noted above, shelf unit 10 is preferably fabricated from plastic coated metal wire. In this regard, the resilient nature of the plastic coating provides a highly frictional engagement of each offset portion 20 with the like shelf unit shown in the drawing. In this way, the stability of stacked shelf units is enhanced.

It will be appreciated that the frictional engagement of the offset portion of each leg 16 of the shelf unit with a like shelf unit could be further enhanced by providing a biased engagement of the two shelf units. For example, if each leg portion 16 of the shelf unit 10 shown depended straight downwardly, and like shelf unit 22 is similar to shelf unit 10, it would be necessary for leg portions 16 to be urged or biased inwardly so that offset portions 20 of each leg 16 clear side frame members 24 of like shelf unit 22, and properly seat upon the portion of like shelf unit 22 they are adapted to engage (such as shelf members 26 and portions of side frame member 24 as shown). Due to the resilient nature of the preferred coated wire construction of the present shelf unit, flexing of the shelf unit in this manner may be easily accomplished, with the resilient nature causing leg portions 16 to be biased outwardly thus enhancing engagement with like shelf unit 22. Similarly, leg portions 16 could be formed so as to extend slightly outwardly of shelf unit 10 (thus having a somewhat splayed configuration) so that after they are flexed inwardly to accommodate stacking of shelf unit 10 on a like shelf unit, the resilient nature of the unit urges the leg portions outwardly into engagement with the like shelf unit for added stability in stacking of shelf units.

It should be noted that while the present disclosure has discussed the stackable nature of shelf unit 10 with regard to a "a like shelf unit", the like shelf unit may be other than a shelf unit substantially similar to shelf unit 10. For instance, shelf unit 10 could easily be stacked upon a shelf unit having a like construction, such as where side frame members of the like shelf unit are similarly spaced but are longer than side frame members 12 of shelf unit 10. Additionally, the direction and configuration of offset portions 20 of each leg portion 16 could be altered or varied so that each offset portion is adapted to engage other than a shelf member of a like shelf unit upon which shelf unit 10 is stacked.

Thus, a simple, efficient stackable shelf unit is disclosed for convenience in assembling a multitiered shelf arrangement. From the foregoing, it will be appreciated that numerous variations and modifications may be effected without departing from the true spirit and scope of the present invention. It will be understood that no limitation with respect to the specific embodiment illustrated herein is intended or should be inferred. It is, of course, intended to cover by the appended claims all such modifications as fall within the scope of the claims.

What is claimed is:

1. A stackable shelf unit capable of being supported and stacked upon an associated like shelf unit without the use of fasteners, comprising:

a pair of laterally spaced, generally U-shaped side frame members arranged in parallel relation, each said side frame member comprising a single length of metal wire and each including a horizontal portion and a pair of integral, downwardly depending resiliently flexible legs extending downwardly from respective ends of said horizontal portion at generally right angles;

a plurality of spaced apart, laterally extending shelf members affixed to and extending between said horizontal portions of said side frame members for supporting objects, said resilient legs depending freely below said shelf members, the endmost ones of said shelf members extending between respective ends of said horizontal portions in closely spaced relation to said freely depending resilient legs; and releasably lockable stacking means comprising an offset portion of each of said legs; each said offset portion including a substantially horizontal support portion adapted to be supported on said like shelf unit, and a substantially vertical locking portion depending from said horizontal portion, each said horizontal portion extending longitudinally relative to said shelf unit a distance corresponding to the relative positioning of said endmost ones of shelf members with respect to said freely depending legs so that stacking with said like shelf unit can be effected by disposition of the endmost ones of the shelf members of the like shelf unit at the respective junctions of the horizontal support portions and vertical locking portions of the offset portions of said freely depending legs, said stacking means providing resiliently biased, releasable engagement of each said offset portion with said associated like shelf unit by the resilience of said legs for support and stacking of the shelf unit on said like shelf unit.

2. A stackable shelf unit in accordance with claim 1, wherein said horizontal support portion of each said offset portion extends longitudinally inwardly of said shelf unit for engagement of said offset portions with said endmost spaced shelf members extending between laterally spaced side frame members of said like shelf unit.

3. The stackable shelf unit in accordance with claims 1 or 2, wherein said side frame members and shelf members comprise plastic-coated wire.

* * * * *